US005133888A

United States Patent [19]

Waynick

[11] Patent Number: 5,133,888

[45] Date of Patent: Jul. 28, 1992

[54] CRUISE MISSILE ENGINE BEARING GREASE

[75] Inventor: John A. Waynick, Bolingbrook, Ill.

[73] Assignee: Amoco Corporation, Chicago, Ill.

[21] Appl. No.: 590,487

[22] Filed: Sep. 28, 1990

[51] Int. Cl.[5] ..... C10M 107/10; C10M 117/02

[52] U.S. Cl. ..... 252/33.4; 252/41; 252/47; 252/56 S; 252/42.1; 252/49.6; 252/49.9

[58] Field of Search ..... 252/33.4, 41, 42.1, 252/47, 49.6, 49.9, 565

[56] References Cited

U.S. PATENT DOCUMENTS

| | | | |
|---|---|---|---|
| 2,721,844 | 10/1955 | Culnane et al. | 252/42.1 |
| 3,482,562 | 2/1969 | Crouch et al. | 252/42 |
| 3,860,522 | 1/1975 | Fischer et al. | 252/565 |
| 4,406,800 | 9/1983 | Christian | 252/28 |
| 4,749,502 | 6/1988 | Alexander et al. | 252/41 |
| 4,879,054 | 11/1989 | Waynick | 252/41 |

*Primary Examiner*—Jacqueline Howard
*Attorney, Agent, or Firm*—Thomas W. Tolpin; William H. Magidson; Frank J. Sroka

[57] ABSTRACT

A high performance cruise missile grease is provided that performs well at extremely cold temperatures and moderately elevated temperatures, as well as under normal operation conditions. The high performance grease comprises: a lithium soap thickener, a synthetic base oil blend of polyalphaolefin and extreme pressure antiwear additives and inhibitors comprising dithiocarbamates, phosphates, and hydroxides.

6 Claims, No Drawings

CRUISE MISSILE ENGINE BEARING GREASE

BACKGROUND OF THE INVENTION

This invention relates to greases and, more particularly, to lithium soap thickened greases.

In lubrication of engine bearings of cruise missiles, low temperature requirements are severe, requiring good performance during start-up at temperatures as low as −65° F. Other demands include improved rust protection even when exposed to humid conditions for years. Also, oil separation from the bearings must be minimized for extended periods of time since cruise missiles may be stored for years before being used. In addition, outstanding oxidation stability is required to assure maintenance of the grease's bearing lubrication properties. Furthermore, after very long periods of storage under humid conditions and/or low temperature, the grease must provide excellent bearing lubrication during sudden start-up and continue to provide such protection during the entire flight of the missile. Failure to perform in this manner could cause the cruise missile to fail to reach its objective and instead terminate its flight at an unintended and unknown site. Clearly, such an occurrence could be disastrous.

Actual performance demands of the lubricating grease during extended storage, start-up, and flight of the cruise missile are quite extensive and cannot be measured by any of the typical bench tests commonly used to evaluate lubricating greases. Special test rigs designed specifically to simulate conditions experienced by the bearing during storage, firing, and flight of strategic cruise missiles are required to insure that the grease will perform adequately.

Conventional mineral oil-based greases are limited in their usefulness in low temperature applications. For example, greases made from paraffinic mineral oil often provide below average performance at low temperatures because of wax which is usually present in the grease. At temperatures below 0° F., wax can crystallize out and render the grease hard and non-pliable. Dewaxing processes can reduce the wax level in paraffinic mineral oil but cannot eliminate it altogether. Naphthenic mineral oils have virtually no wax and have better low temperature flow properties, but do not give good flow properties at extremely low temperatures, such as −40° F. to −65° F. Also, naphthenic oils are more prone to oxidative and thermal degradation at high temperatures.

In lithium soap thickened greases, the metal base, usually lithium hydroxide or in its more commonly available form of lithium hydroxide monohydrate, is reacted with a fatty acid, usually 12-hydroxystearic acid, or with a fatty acid derivative, usually methyl 12-hydroxystearate or hydrogenated castor oil. This reaction is most often carried out in the base oil with water also being present. The water is added to act as a reaction solvent if the acid is used. If the fatty acid derivative is used, the water acts both as reaction solvent and reactant, the latter effect being necessary for the hydrolytic cleavage of the ester linkages in the methyl 12-hydroxystearate or the hydrogenated castor oil.

Typifying some of the many types of prior art lubricating oils, greases, and additives, are those described in U.S. Pat. Nos. 3,622,512; 3,853,775; 3,876,550; 3,890,363; 4,514,312; 4,536,308; 4,735,146; 4,759,859; 4,787,992; 4,830,767; 4,858,534; 4,859,352; 4,879,054; 4,902,435; and 4,904,399. These prior art lubricating oils, greases, and additives have met with varying degrees of success but have not been demonstrated to perform well for cruise missile engine bearings.

It is, therefore, desirable to provide an improved lithium grease for use in cruise missile bearings.

SUMMARY OF THE INVENTION

An improved lithium soap thickened grease is provided for cruise missile engine bearings. Advantageously, the improved grease performs well at normal temperatures and ambient conditions as well as at extreme temperatures, including low temperatures, such as at least −65° F., and elevated temperatures, such as at least +275° F. or higher. Desirably, the novel lithium soap thickened grease has outstanding oxidation resistance, good extreme pressure (EP) and antiwear properties, superior pliability, enhanced pumpability, and excellent stability at the above temperature ranges.

The novel grease has excellent shear stability, low oil bleed over long storage times, good water resistance, and excellent resistance to ferrous and copper corrosion. The grease is also reliable, consistent, safe, economical, effective, and easy to manufacture. The novel grease further provides exceptional performance qualities at low temperatures as well as at elevated temperatures under the extreme bearing rotation speeds and thrust loads experienced during the firing and flight of a cruise missile. Furthermore, the novel grease is able to perform in the required manner even after prolonged storage under humid and/or corrosive conditions.

Desirably, the grease can be readily formulated and blended without elaborate procedures and temperature control devices which are often required for blending prior art lithium soap thickened greases.

To this end, the novel grease comprises a synthetic oil, a lithium soap thickener, and a low temperature compatible additive package. The special synthetic oil blend comprises polyalphaolefin (PAO).

Polyalphaolefin (PAO) is economical, has many fine qualities, is generally reliable and performs well at low temperatures, such as −40° F., and even −65° F.

The additive package preferably comprises a blend or mixture of compounds containing dithiocarbamates, phosphates, and hydroxides as well as corrosion and oxidation inhibitors and metal deactivators.

The novel grease composition comprises a synergistic combination of compounds, ingredients, or components, each of which alone is insufficient to give the desired properties, but when used in concert give the outstanding grease properties of this invention.

In order to produce and manufacture the novel, high performance, low temperature grease, a thickener comprising lithium 12-hydroxystearate soap is formed by reacting 12-hydroxystearic acid, methyl 12-hydroxystearate, or hydrogenated castor oil with a lithium base, such as lithium hydroxide or lithium hydroxide monohydrate. The lithium soap thickener is formed in and mixed with PAO, preferably in the presence of water. Thereafter, the water and any alcoholic by-products of saponification are removed. A sufficient amount of additives are added to the mixture to impart extreme pressure (EP) and antiwear as well as other properties to the grease. Such additives can include substantially ashless dithiocarbamate and substantially ashless aryl phosphate, both of which are soluble in PAO. Other additives can also be useful.

Preferably, this new grease is formed by first making a lithium 12-hydroxystearate grease concentrate in all PAO. Then the dried grease concentrate is cooled, such as to about 200° F. to 250° F. At this point additives and PAO can be added to the grease concentrate to obtain the final cruise missile bearing grease composition.

By adding the excess lithium hydroxide monohydrate at the beginning of the grease manufacturing procedure, along with the PAO and 12-hydroxystearic acid, before lithium 12-hydroxystearate soap is formed, one minimizes and virtually eliminates unreacted 12-hydroxystearic acid in the dry base grease. Under these conditions, the base grease can be safely heated to the thickener melt point (+400° F.) without any substantial esterification of unreacted 12-hydroxystearic acid and hydroxyl groups of the melted lithium 12-hydroxystearate thickener.

A more detailed explanation of the invention is provided in the following description and appended claims.

DETAILED DESCRIPTION OF THE PREFERRED EMBODIMENT

A cruise missile engine bearing grease provides excellent performance qualities at both very low temperatures, such as at least −65° F., and moderately high temperatures, such as at least +275° F., or higher, as well as under normal conditions and mid-range temperatures therebetween. The cruise missile engine bearing grease comprises, by weight: from about 65% to about 93% of a synthetic base oil comprising polyalphaolefin (PAO), from about 5% to about 20% lithium 12-hydroxystearate soap thickener, and from about 2% to about 16% of an additive package comprising a blend of additives for imparting extreme pressure (EP) and antiwear properties to the grease as well as for inhibiting oxidation, oil separation (oil bleeding) in the grease, and corrosion of copper and iron.

Preferably, the cruise missile engine bearing grease comprises, by weight: from about 71% to about 88% PAO synthetic base oil, from about 8% to about 17% lithium 12-hydroxystearate soap thickener, and from about 4% to about 14% additives.

For best results at both low temperatures and moderately high temperatures, cruise missile engine bearing grease comprises by weight: from about 75% to about 84% PAO synthetic base oil, from about 10% to about 15% lithium 12-hydroxystearate soap thickener, and from about 6% to about 12% additives.

Polyalphaolefin is a synthetic fluid. It is effective at high temperatures, such as occurs during operation of internal combustion engines of vehicles or during shooting (firing) of projectiles from tanks, cannons, and howitzers. It is also very effective at low temperatures such −40° F. and even −65° F. Polyalphaolefin provides superior oxidation and hydrolytic stability and high film strength. Polyalphaolefin also has a higher molecular weight, higher flash point, higher fire point, lower volatility, higher viscosity index, and lower pour point than mineral oil.

Polyalphaolefin has a typical molecular structure as follows:

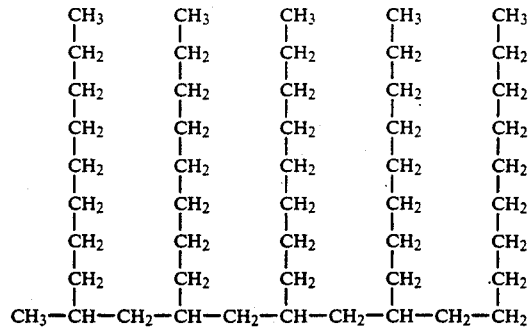

One particularly useful type of PAO is sold by Emery Chemicals under the brand name Emery 3004. Emery 3004 polyalphaolefin has a viscosity of 3.86 centistokes (cSt) at +212° F. (100° C.) and 16.75 cSt at +104° F. (40° C.). It has a viscosity index of 125 and a pour point of −98° F. It also has a flash point of +432° F. and a fire point of 478° F.

Gulf Synfluid 4 cSt PAO, commercially available from Gulf Oil Chemicals Company, a subsidiary of Chevron Corporation, is similar in many respects to Emery 3004. Mobil SHF-41 PAO, commercially available from Mobil Chemical Corporation, is also similar in many respects to Emery 3004.

Another useful type of PAO is sold by Emery Chemicals under the brand name of Emery 3006. Emery 3006 polyalphaolefin has a viscosity of 5.88 cSt at +212° F. and 31.22 cSt at +104° F. It has a viscosity index of 135 and a pour point of −87° F. It also has a flash point of +464° F. and a fire point of +514° F.

A further useful type of PAO is sold by Uniroyal, Inc. under the brand name SYNTON PAO-40. SYNTON PAO-40 polyalphaolefin has a viscosity of 188 SUS at 212° F. and 2131 SUS at 104° F. It has a viscosity index of 142 and a pour point of −55° F. It has a molecular weight of 1450, a flash point of +550° F., and a fire point of +605° F.

Another PAO similar to the SYNTON PAO-40 is sold by Mobil Chemical Company under the brand name SHF-401. SHF-401 has a viscosity of 39.5 centistokes at 99° F., a viscosity index of 145, a pour point of −30° F., a flash point of 545° F., and a fire point of 595° F.

The additives comprise by weight, based upon the total cumulative weight of the additives: (a) from about 10% to about 50%, preferably about 20% to about 42%, and most preferably about 30% to about 40% substantially ashless dithiocarbamate comprising dithiocarbamate-containing compounds; (b) from about 10% to about 50%, preferably about 20% to about 42%, and most preferably about 30% to about 40% of a phosphate-containing compound; (c) from about 0.3% to about 6%, preferably from about 0.8% to about 4%, and most preferably from about 1% to about 3% excess lithium hydroxide-containing compounds; (d) from about 6% to about 44%, preferably from about 10% to about 38%, and most preferably from about 20% to about 33% of iron corrosion inhibitors, also referred to as rust corrosion inhibiting agents and anticorrodants; (e) from about 1% to about 12%, preferably from about 2% to about 10%, and most preferably about 4% to about 8% oxidation inhibitors or antioxidants; and (f) from about 0.2% to about 2%, preferably from about 0.6% to about 1.6%, and most preferably from about 0.8% to about 1.4% metal deactivators or metal passivators.

The dithiocarbamate-containing compounds can comprise one or more of the following compounds: alkylene bis dithiocarbamate, arylene bis dithiocarbamate, or alkyl arylene bis dithiocarbamate. For best results, the dithiocarbamate comprises a 4,4'-methylene bis dithiocarbamate (ashless dibutyldithiocarbamate), such as is commercially available under the brand name Vanlube 7723 by R. T. Vanderbilt Company, Inc. Dithiocarbamate-containing compounds provide extreme pressure (EP) and antiwear properties.

The phosphate-containing compounds can comprise: alkyl phosphate, alkyl aryl phosphate, and/or preferably aryl phosphate. For best results, the phosphate-containing compounds comprise triaryl phosphate, such as sold under the brand name Durad 150 by FMC Corporation. Phosphate-containing compounds enhance the antiwear as well as the EP properties of the grease.

The lithium hydroxide-containing compounds can comprise lithium hydroxide monohydrate or anhydrous lithium hydroxide. The above lithium hydroxide-containing compounds are in excess of the stoichiometric amount required to react all of 12-hydroxystearic acid or methyl 12-hydroxystearate to form lithium 12-hydroxystearate soap thickener. The excess lithium hydroxide-containing compounds are preferably added along with the stoichiometric amount of lithium hydroxide monohydrate used to form the lithium 12-hydroxystearate thickener as further described below. When added in this way, any water of hydration in the lithium hydroxide-containing compounds is volatilized and is removed along with the other volatile by-products.

The excess lithium hydroxide virtually eliminates unreacted 12-hydroxystearic acid, thereby permitting the grease concentrate to be heated to at least the thickener melting point without any substantial esterification of unreacted 12-hydroxystearic acid with hydroxyl groups of melted lithium hydroxystearate thickener.

Corrosion inhibiting agents or anticorrodants prevent rusting of iron by water, suppress attack by acidic bodies, and form protective film over metal surfaces to diminish corrosion of exposed metallic parts. A typical corrosion inhibiting agent is an alkali metal nitrite, such as sodium nitrite. Other ferrous corrosion inhibitors include metal sulfonate salts, alkyl and aryl succinic acids and their salts, and alkyl and aryl succinate esters, amides, and other related derivatives. Borated esters, amines, ethers, and alcohols can also be used with varying success to limit ferrous corrosion. The preferred corrosion (rust) inhibitor comprises alkaline earth metal alkyl sulfonate. Most preferably, for best results, the corrosion inhibitor comprises a mixture of barium dinonyl naphthalene sulfonate in PAO, such as sold under the brand name NaSul BSN/PAO by R. T. Vanderbilt Company, Inc. and borated amine, such as sold under the brand name of Lubrizol 5391 by The Lubrizol Corporation.

Antioxidants or oxidation inhibitors prevent varnish and sludge formation in lubricating oils and oxidation of mineral oil and/or synthetic oil in lubricating greases. Typical antioxidants are organic compounds containing nitrogen, such as organic amines, sulfides, hydroxy sulfides, phenols, etc., alone or in combination with metals like zinc, tin, or barium, as well as phenyl alpha-naphthylamine, bis(alkylphenyl)amine, N,N - diphenyl-p-phenylenediamine, 2,2,4 - trimethyldihydroquinoline oligomer, bis(4 - isopropylaminophenyl)-ether, N-acyl-p-aminophenol, N - acylphenothiazines, N - ethylenediamine tetraacetic acid, and alkylphenol-formaldehyde-amine polycondensates.

Metal deactivators or metal passivators prevent undesirable interactions between lubricant and metal surfaces, diminish copper corrosion, and counteract the effects of metal on oxidation by forming catalytically inactive compounds with soluble or insoluble metal ions. The most common mechanisms by which such additives function involve either complexing the metal surface or forming a tenacious film on the surface. In either case, the metal surface is rendered unavailable for otherwise harmful catalytic or corrosive activity. The metal deactivators or passivators can comprise organic nitrogen and sulfur-containing compounds. Preferably, the metal deactivator or passivator comprises mercaptobenzothiazole or derivatives thereof. Most preferably, for best results, the metal deactivator or passivator comprises sulfur-free triazole derivatives, such as sold under the brand name Reomet 39 by Ciba-Geigy Company.

If desired, the additives can also include dyes or pigments to impart a desired color to the grease, supplemental oil separation inhibitors and tackiness agents, such as sold under the brand name Paratac by Paramins Chemical Company, a division of Exxon.

In order to produce and manufacture the cruise missile engine bearing grease, a lithium 12-hydroxystearate grease concentrate in polyalphaolefin (PAO) is first formed and mixed in a container, such as a kettle, pot, vessel, or tank. This can be accomplished by adding a 12-hydroxystearic compound, such as 12-hydroxystearic acid or methyl 12-hydroxystearate, to PAO and subsequently adding water and a chemically equivalent (stoichiometric amount) of lithium hydroxide monohydrate to react substantially with all of the 12-hydroxystearic compound. The 12-hydroxystearic compound, PAO, water, and lithium hydroxide monohydrate are heated to about +300° F. and simultaneously mixed (stirred) to form lithium 12-hydroxystearate soap thickener in PAO. The resultant mixture is dried while vaporizing and venting the volatile by-products of reaction. When 12-hydroxystearic acid is used, the volatile byproducts of reaction comprise water vapor (water of hydration and water of reaction). When methyl 12-hydroxystearate is used, the volatile byproducts of reaction comprise methyl alcohol and water vapor.

Preferably, the excess lithium hydroxide is added with the stoichiometric equivalent amount of lithium hydroxide to insure complete reaction of 12-hydroxystearic acid, thereby substantially preventing esterification of unreacted 12-hydroxystearic acid with hydroxyl groups of melted lithium 12-hydroxystearate thickener.

Once the volatile by-products are removed, the grease concentrate is generally heated to the melting point of the lithium 12-hydroxystearate, about 400° F, thereby promoting improved thickener yield and shear stability of the final grease.

After the final grease composition is achieved, the resulting grease is generally passed one or more times through a relatively high shearing or dispersing device to enhance the smoothness, improve oil bleed and shear stability characteristics, and maximize the thickening power of the grease thickener. Such shearing devices include Gaulin homogenizers, colloid mills, rotating knife-edge mills, and the like.

The following examples in their entirety exemplify the technology described. The novel grease compositions in the examples provide excellent performance at very low temperatures while also maintaining excellent performance at elevated temperatures and normal temperatures, as well as provide low oil separation, resistance to ferrous and copper corrosion, shear stability, water resistance, oxidation stability, and other desirable high performance properties. The following examples culminate in the grease of Example 15 which was evaluated according to a special test program designed and specified by Air Force Wright Aeronautical Laboratories of the Air Force Systems Command located at Wright Patterson Air Force Base, Ohio.

The following examples are for purposes of illustration and not for purposes of limiting the scope of the invention as provided in the appended claims.

EXAMPLE 1

A lithium 12-hydroxystearate base grease using a blend of two polyalphaolefins (PAO) was made. The PAO used is commercially available under the brand name Emery 3006 from Emery Chemicals and Mobil SHF-401 from Mobil Chemical Company. Emery 3006 has a kinematic viscosity of about 6 centistokes (cSt) at 100° C. The Mobil SHF-401 has a kinematic viscosity of about 39.5 centistokes at 99° C.

The base grease was made in a laboratory grease kettle by the following procedure. About 8.24 pounds of Emery 3006 PAO and 12.35 pounds of SHF-401 were placed (charged) in a kettle and heated to +180° F. while stirring. About 3,261.9 grams of methyl 12-hydroxystearate were added to the kettle and mixed (stirred) with the PAO at +180° F. until the mixture was melted. About 880 ml of water and 482.81 grams of lithium hydroxide monohydrate were added to the kettle. This amount of lithium hydroxide monohydrate included the stoichiometric amount required to react with all the methyl 12-hydroxystearate. It also included excess lithium hydroxide monohydrate in an amount which is specified below. The kettle was closed, continuously stirred and heated with jacket steam. Such heating sequentially occurred for: (a) 30 minutes with 50 psi jacket stream; (b) 90 minutes with 100 psi jacket steam; (c) 60 minutes with 100 psi jacket steam and electrical heat from the heating coils in the kettle walls. The water vapor was then vented from the sealed kettle and the kettle opened. To the dry base grease in the kettle was then added 158.90 grams of phenyl alphanaphthylamine (commercially available under the brand name Amoco 32 from Amoco Chemical Company). The base grease comprising the contents in the kettle was heated to about +370° F. with the electric heating coils. Then 6.53 pounds of SHF-401 and 4.36 pounds of Emery 3006 were added to the kettle. The resulting grease was heated to 400° F. with electric heating coils until the thickener melted. The base grease was stirred, mixed, and concurrently cooled to +300° F. using water in the jacket. Then the base grease was removed from the kettle and stored for later use. The base grease made by the above procedure had the following composition:

| Component | % (wt) |
|---|---|
| SHF-401 | 48.57 |
| Emery 3006 (PAO) | 32.38 |
| Lithium 12-hydroxystearate | 18.00 |
| Amoco 32 | 0.90 |
| Excess Lithium Hydroxide | 0.15 |

It should be noted that the excess lithium hydroxide is reported as anhydrous even though it was added as lithium hydroxide monohydrate. This is because it was added as part of the entire charge of lithium hydroxide monohydrate at the beginning of the batch and as such was heated to 400° F., well above the temperature at which the water of hydration is removed.

EXAMPLES 2-6

Five samples of grease were made by mixing portions of the base grease of Example 1 with varying amounts of 4,4'-methylene bis(dibutyldithiocarbamate), commercially available under the brand name Vanlube 7723 by R. T. Vanderbilt Company, and triaryl phosphate, commercially available under the brand name Durad 150 by FMC Corporation. Although the amounts of each additive were varied, the total concentration of both additives was held at 6% for all five greases. Also, additional amounts of PAO were added to bring the thickener level of all five samples to 12%. Each sample was mixed well and then given three passes through a three roll mill to assure a homogenous texture. Each sample was tested for extreme pressure and wear resistance properties by the ASTM D2596 Four Ball EP test and the Optimol SRV Stepload test. The latter test is the procedure specified by the U.S. Air Force Laboratories Test Procedure of Mar. 6, 1985. In the test, a 10 mm steel ball is oscillated under load increments of 100 newtons on a lapped steel disc lubricated with the grease being tested until seizure occurs. Composition and test data for the five greases are given below.

| Example No. | 2 | 3 | 4 | 5 | 6 |
|---|---|---|---|---|---|
| Example 1 Grease, grams | 150.00 | 150.00 | 150.00 | 150.00 | 150.00 |
| Vanlube 7723, grams | — | 4.50 | 6.75 | 9.00 | 13.50 |
| Durad 150, grams | 13.50 | 9.00 | 6.75 | 4.50 | — |
| SHF-401, grams | 36.90 | 36.90 | 36.90 | 36.90 | 36.90 |
| Emery 3006, grams | 24.60 | 24.60 | 24.60 | 24.60 | 24.60 |
| Component, % (wt) | | | | | |
| SHF-401 | 48.78 | 48.78 | 48.78 | 48.78 | 48.78 |
| Emery 3006 | 32.52 | 32.52 | 32.52 | 32.52 | 32.52 |
| Lithium 12-Hydroxystearate | 12.00 | 12.00 | 12.00 | 12.00 | 12.00 |
| Vanlube 7723 | — | 2.00 | 3.00 | 4.00 | 6.00 |
| Durad 150 | 6.00 | 4.00 | 3.00 | 2.00 | — |
| Excess Lithium Hydroxide | 0.10 | 0.10 | 0.10 | 0.10 | 0.10 |
| Amoco 32 | 0.60 | 0.60 | 0.60 | 0.60 | 0.60 |
| Test Data | | | | | |
| Four Ball EP, ASTM D2596, Weld Load, Kg | 126 | 160 | 200 | 200 | 200 |
| Optimol SRV Stepload Test, | 200 | 400 | 1,200 | 1,200 | 1,200 |

-continued

| Example No. | 2 | 3 | 4 | 5 | 6 |
|---|---|---|---|---|---|
| 80° C., Newtons Passed | | | | | |

As can be seen, the combination of Vanlube 7723 and Durad 150 in a lithium 12-hydroxystearate thickened grease containing PAO as the only synthetic base oil component gave disproportionately improved results when compared to greases containing equivalent total amounts of either additive alone. This disproportional improvement was most apparent in Example 4 which contained 3% each of the Vanlube 7723 and Durad 150.

EXAMPLE 7

The grease of Example 4 was further evaluated by subjecting it to the ASTM D4048 Copper Strip Corrosion Test. The standard conditions of 24 hours and 212° F. were used. At the end of the test the copper strip was rated 2 C, indicating significant corrosion.

EXAMPLE 8

Another grease similar to that of Example 7 was made. The only difference was that 0.10% oil soluble triazole derivative, commercially available under the brand name Reomet 39 by Ciba Geigy was also added to the grease. As with the grease of Example 7, this grease was also subjected to the ASTM D4048 Copper Strip Corrosion Test. The standard conditions of 24 hours and 212° F. were used. At the end of the test the copper strip was rated 1 B, indicating minimal corrosion.

EXAMPLE 9

A lithium 12-hydroxystearate base grease using a blend of two polyalphaolefins (PAO) was made. The PAO used is commercially available under the brand name Emery 3006 from Emery Chemicals and Synton PAO-40 from Uniroyal, Inc. Emery 3006 has a kinematic viscosity of about 6 centistokes (cSt) at 100° C. The Synton PAO-40 has a kinematic viscosity of about 188 Saybolt Universal Seconds (SUS) at 100° C.

The base grease was made in a laboratory grease kettle by the following procedure. About 6.49 pounds of Emery 3006 PAO and 9.73 pounds of Synton PAO-40 were placed (charged) in a kettle and heated to +180° F. while stirring. About 2,562.9 grams of methyl 12-hydroxystearate was added to the kettle and mixed (stirred) with the PAO at +180° F. until the mixture was melted. About 700 ml of water and 383.52 grams of lithium hydroxide monohydrate were added to the kettle. This amount of lithium hydroxide monohydrate included the stoichiometric amount required to react with all the methyl 12-hydroxystearate. It also included excess lithium hydroxide monohydrate in an amount which is specified below. The kettle was closed, continuously stirred and heated with jacket steam. Such heating sequentially occurred for: (a) 10 minutes with 25 psi jacket stream; (b) 60 minutes with 100 psi jacket steam; (c) 60 minutes with 100 psi jacket steam and electrical heat from the heating coils in the kettle walls. The water vapor was then vented from the sealed kettle and the kettle opened. To the dry base grease in the kettle was then added 104.04 grams of phenyl alphanaphthylamine (commercially available under the brand name Amoco 32 from Amoco Chemical Company). The base grease comprising the contents in the kettle was heated to about +400° F. with the electric heating coils until the thickener was melted. The base grease was stirred, mixed, and concurrently cooled to +300° F. using water in the jacket. Then 7.43 pounds of Synton PAO-40 and 4.95 pounds of Emery 3006 PAO was added to the kettle and the resulting base grease was stirred for another 30 minutes. The base grease was then removed and stored for future use. The base grease made by the above procedure had the following composition:

| Component | % (wt) |
|---|---|
| Synton PAO-40 | 49.90 |
| Emery 3006 (PAO) | 33.28 |
| Lithium 12-hydroxystearate | 16.00 |
| Phenyl alpha-naphthylamine | 0.67 |
| Excess Lithium Hydroxide | 0.15 |

It should be noted that the excess lithium hydroxide is reported as anhydrous even though it was added as lithium hydroxide monohydrate. This is because it was added as part of the entire charge of lithium hydroxide monohydrate at the beginning of the batch and as such was heated to 400° F., well above the temperature at which the water of hydration is removed.

EXAMPLE 10

A portion of the base grease of Example 9 was placed in a 25 pound capacity laboratory grease kettle and sufficient additives as used in Example 8 and PAO were added to obtain a finished cruise missile bearing grease. Barium dinonylnaphthalene sulfonate in PAO, sold as Nasul BSN/PAO by King Industries and borated amine, sold as Lubrizol 5391 by The Lubrizol Corporation were also added to the grease. The grease was milled through a colloid mill with a gap clearance of 0.001 inch to obtain a smooth texture. The final grease had the following composition and test data.

| Component, % (wt) | |
|---|---|
| Synton PAO-40 | 47.84 |
| Emery 3006 | 31.90 |
| Lithium 12-Hydroxystearate | 11.55 |
| Vanlube 7723 | 3.00 |
| Durad 150 | 3.00 |
| Nasul BSN/PAO | 1.00 |
| Lubrizol 5391 | 1.00 |
| Reomet 39 | 0.10 |
| Excess Lithium Hydroxide | 0.11 |
| Amoco 32 | 0.50 |
| Test Data | |
| Penetration, ASTM D217, | |
| Worked 60 Strokes | 306 |
| Worked 100,000 Strokes | 347 |
| Dropping Point, ASTM D2265, °F. | 412 |
| Oil Separation, FTM 321, % | |
| 24 hr, 212° F. | 4.1 |
| 116 hr, 212° F. | 6.9 |
| 1 week, 125° F. | 0.6 |
| 2 week, 125° F. | 0.8 |
| 4 week, 125° F. | 0.8 |
| Copper Strip Corrosion, ASTM D4048 | 1A |
| Four Ball Wear, ASTM D2266 (40 Kg, 1,200 rpm, 75° C., 1 hr.), mm | 0.40 |
| Corrosion Prevention (Rust), ASTM D1743 5% Synthetic Sea Water | Fail, Fail |
| Water Washout at 100° F., % Loss, ASTM D1264. | 4.3 |
| High Temperature Bearing Performance | 2,200+ |

-continued

| Component, % (wt) | |
|---|---|
| at 275° F., ASTM D3336, hrs. to fail | |
| Optimol SRV Stepload Test, 80° C., Newtons Passed | 700 |

As can be seen the performance is generally excellent. The high temperature bearing performance is especially outstanding. Even after 2,200 hours the bearing had not failed. When removed and examined the bearing looked new and the grease had not changed from its original appearance. The prolonged oil separation tests were done at temperatures which can be reasonably achieved during the summer months in missile silos. As can be seen the extent of oil separation appears to level off after four weeks and remains very low.

EXAMPLES 11-13

The grease of Example 10 did not pass the 5% synthetic sea water modification of the ASTM D1743 Corrosion Prevention Test even though it was tested twice. To attempt to increase the corrosion protection properties of the cruise missile grease, three samples of the grease of Example 10 were augmented with additional amounts of either Nasul BSN/PAO, Lubrizol 5391, or both Nasul BSN/PAO and Lubrizol 5391. The resulting three greases were well mixed and given three passes through a three roll mill to assure a homogenous grease. The three greases were then subjected to the ASTM D1743 Corrosion Prevention Test with the 5% synthetic sea water modification. Composition and test results are given below.

| Example No. | 11 | 12 | 13 |
|---|---|---|---|
| Example 10 Grease, grams | 100.00 | 100.00 | 100.00 |
| Nasul BSN/PAO, grams | 1.00 | — | 0.50 |
| Lubrizol 5391, grams | — | 1.00 | 0.50 |
| Component, % (wt) | | | |
| Nasul BSN/PAO | 2.0 | 1.0 | 1.5 |
| Lubrizol 5391 | 1.0 | 2.0 | 1.5 |
| Test Data | | | |
| Corrosion Prevention (Rust), ASTM D1743 5% Synthetic Sea Water | Fail | Fail | Pass |

All three greases had a total of 3% corrosion (rust) inhibitor. As can be seen the grease of Example 13 passed the test; the greases of Examples 11 and 12 did not.

EXAMPLE 14

A grease similar to that of Example 10 was made using a portion of the base grease of Example 1. Conditions of manufacturing and milling were identical to that used in Example 10. The only difference was that the adjusted levels of Nasul BSN/PAO and Lubrizol 5391 of Example 13 were used, i.e., 1.5% of Nasul BSN/PAO and 1.5% of Lubrizol 5391. Final cruise missile engine bearing grease composition and test results are given below.

| Component, % (wt) | |
|---|---|
| SHF-401 | 46.98 |
| Emery 3006 | 31.32 |
| Lithium 12-Hydroxystearate | 12.00 |
| Vanlube 7723 | 3.00 |
| Durad 150 | 3.00 |
| Nasul BSN/PAO | 1.50 |

-continued

| Component, % (wt) | |
|---|---|
| Lubrizol 5391 | 1.50 |
| Reomet 39 | 0.10 |
| Excess Lithium Hydroxide | 0.10 |
| Amoco 32 | 0.50 |
| Test Data | |
| Penetration, ASTM D217, | |
| Worked 60 Strokes | 307 |
| Worked 100,000 Strokes | 329 |
| Dropping Point, ASTM D2265, °F. | 403 |
| Oil Separation, FTM 321, % | |
| 24 hr, 212° F. | 2.5 |
| 100 hr, 212° F. | 5.9 |
| Copper Strip Corrosion, ASTM D4048 | 1B |
| Four Ball Wear, ASTM D2266 (40 Kg, 1,200 rpm, 75° C., 1 hr.), mm | 0.37 |
| Four Ball EP, ASTM D2596, Load Wear Index | 40.6 |
| Optimol SRV Stepload Test, 80° C., Newtons Passed | 1,000 |
| Corrosion Prevention (Rust), ASTM D1743 5% Synthetic Sea Water | Pass, Pass |
| Water Washout at 100° F., % Loss, ASTM D1264 | 2.5 |
| Low Temperature Torque at −40° F. ASTM D1478 | |
| Starting, g-m (gram-centimeter) | 3,245 |
| Running, g-m (gram-centimeter) | 590 |
| Low Temperature Torque at −65° F. ASTM D1478 | |
| Starting, g-m (gram-centimeter) | 10,768 |
| Running, g-m (gram-centimeter) | 2,360 |

Test results are excellent. As with Example 13, the grease of Example 14 passed the 5% synthetic sea water modification of the ASTM D1743 Corrosion Prevention Test. Low temperature properties are also quite good, as shown by the low temperature torque values at −40° F. and −65° F.

EXAMPLE 15

Another grease similar to that of Example 14 was made, given the code LG-1447, and evaluated by a special test program designed by the Air Force Wright Aeronautical Laboratories, Air Force Systems Command, Wright-Patterson Air Force Base, Ohio 45433-6533. This test program evaluated the bearing performance of the grease using special test rigs designed to closely approximate actual engine operation in a cruise missile. Actual cruise missile ball bearings were used and the test rig was operated at 30,000 rpm and 396 pounds thrust load. Such tests were run on bearings freshly packed with LG-1447 and on bearings packed with LG-1447 and stored for one, three, and six months in a cabinet at 160° F. and 98-100% relative humidity. LG-1447 gave excellent results and it was concluded that LG-1447 would be a superior lubricant for cruise missile engine bearings under the conditions of the evaluation. It was further concluded that LG-1447 lubricated engines could be stored for prolonged periods in a humid atmosphere without requiring overhaul or recertification.

Among the many advantages of the novel grease and process are:

1. Outstanding performance at extremely low temperature, such as at −65° F.
2. Excellent performance at elevated temperatures, such as +275° F. or higher.
3. Superior performance at normal temperatures and ambient conditions.
4. Good extreme pressure (EP) and antiwear properties.

5. Better pliability, especially at extremely low temperatures, such as −65° F.
6. Enhanced pumpability.
7. Improved shear stability.
8. Excellent resistance to ferrous and copper corrosion.
9. Low oil bleed, even when stored for long periods of time.
10. Less cumbersome to manufacture.
11. Easier to produce with consistent product quality.
12. Provides dependable lubrication under the unique conditions required in cruise missile engine bearings.
13. Provides dependable cruise missile bearing lubrication even after long term exposure to humid, hot conditions.
14. Prevents necessity of cruise missile engine overhaul or recertification, even after long term storage under humid, hot conditions.
15. Economical.
16. Dependable.
17. Safe.
18. Efficient.
19. Effective.

Although embodiments of this invention have been shown and described, it is to be understood that various modifications and substitutions, as well as rearrangement and combination of process steps, can be made by those skilled in the art without departing from the novel spirit and scope of this invention.

What is claimed is:

1. A grease for use in lubricating engine bearings of cruise missiles, comprising:

a synthetic oil blend comprising a blend of two different polyalphaolefins and said different polyalphaolefins have different viscosities;

a lithium soap thickener comprising lithium 12-hydroxystearate;

an extreme temperature additive package comprising a substantially ashless phosphate-containing compound comprising aryl phosphate, and a substantially ashless dithiocarbamate-containing compound selected from the group consisting of alykylene bis dithiocarbamate and arylene bis dithiocarbamate; and a corrosion inhibitor comprising borated amine and barium sulfonate.

2. A grease in accordance with claim 1 wherein said substantially ashless dithiocarbamate-containing compound comprises substantially ashless dibutyldithiocarbamate, said aryl phosphate comprises triaryl phosphate, and said barium sulfonate comprises barium dinonylnaphthalene sulfonate.

3. A grease for use in lubricating engine bearings of cruise missiles, comprising:

a synthetic oil comprising polyalphaolefin, said polyalphaolefin being present in said grease in the absence of mineral oil;

a thickener comprising lithium 12-hydroxystearate;

an additive package comprising a substantially ashless dithiocarbamate-containing compound comprising methylene bis dithiocarbamate, a substantially ashless phosphate-containing compound, a hydroxide-containing compound, a corrosion inhibitor comprising borated amine, an oxidation inhibitor, and a metal deactivator, said synthetic oil cooperating with said thickener and said additive package to impart extreme temperature properties to said grease; and said ashless phosphate-containing compound comprising a member selected from the group consisting of alkyl phosphate, aryl phosphate, alkyl aryl phosphate and triaryl phosphate.

4. A grease in accordance with claim 3 comprising from about 71% to about 88% by weight of said synthetic oil from about 8% to about 17% of said lithium 12-hydroxystearate, and from about 4% to about 12% by weight of said additive package.

5. A grease in accordance with claim 3 wherein said additive package comprises by weight, based upon the total weight of said additive package;

from about 10% to about 50% dithiocarbamate-containing compounds;

from about 10% to about 50% phosphate-containing compounds comprising triaryl phosphate;

from about 0.3% to about 6% lithium hydroxide-containing compounds;

from about 6% to about 44% corrosion inhibitor comprising borated amine;

from about 1% to about 12% oxidation inhibitor; and from about 0.2% to about 2% metal deactivator.

6. A grease for use in lubricating engine bearings of cruise missiles, comprising:

from about 71% to about 88% by weight of polyalphaolefin in the absence of mineral oil;

from about 8% to about 17% by weight lithium 12-hydroxystearate thickener; and from about 4% to about 121% by weight of a blend of additives for imparting extreme temperature and pressure antiwear properties to the grease and for substantially inhibiting oil separation and corrosion of copper and iron, said blend of additives comprising by weight, based upon the total weight of said blend of additives from about 20% to about 42% 4,4'-methylene bis dithiocarbamate;

from about 20% to about 42% aryl phosphate;

from about 0.8% to about 4% lithium hydroxide-containing compound;

from about 20% to about 33% rust corrosion inhibiting agents comprising borated amine;

from about 6% to about 18% alkaline earth metal alkyl sulfonate; and said synthetic oil blend interacting with said lithium 12-hydroxystearate thickener and said blend of additives for enhancing the performance and lubricity of the grease for lubricating engine bearings of cruise missiles at temperatures as low as at least about −100° F. and as high as at least about +250° F.

* * * * *

UNITED STATES PATENT OFFICE
CERTIFICATE OF CORRECTION

Patent No. 5,133,888 Dated July 28, 1992

Inventor(s) John A. Waynick

It is certified that error appears in the above-identified patent and that said Letters Patent is hereby corrected as shown below:

| Col | Line | |
|---|---|---|
| 1 | 3 | Before BACKGROUND OF THE INVENTION, insert the following: --This invention was made with Government support under Contract F33615-84-C-5127 awarded by the Department of the Air Force. The Government has certain rights to this invention.-- |
| 14 | 37 | "4% to about 121%" should be --4% to about 12%-- |

Signed and Sealed this

Twenty-first Day of September, 1993

Bruce Lehman

*Attest:*

BRUCE LEHMAN

*Attesting Officer*

*Commissioner of Patents and Trademarks*